US006053435A

United States Patent [19]

Hung

[11] Patent Number: 6,053,435

[45] Date of Patent: Apr. 25, 2000

[54] FOG GENERATING GUIDE TUBE MOUNTING ARRANGEMENT

[76] Inventor: Ping Fa Hung, No. 8, Lane 231, Sec. 1, Nan Kan Rd., Lu Chu Hsiang, Tao Yuan Hsien, Taiwan

[21] Appl. No.: 09/137,305

[22] Filed: Aug. 21, 1998

[51] Int. Cl.[7] ..... B05B 1/24

[52] U.S. Cl. ..... 239/590; 239/136; 239/288; 239/397.5; 239/589; 392/397

[58] Field of Search ..... 239/136, 288, 239/288.3, 288.5, 397.5, 589, 590; 392/396, 397, 398, 473, 484, 488

[56] References Cited

U.S. PATENT DOCUMENTS

| | | | |
|---|---|---|---|
| 1,855,898 | 4/1932 | Alexander | 392/398 |
| 2,806,522 | 9/1957 | Stalego | 239/397.5 |
| 3,458,948 | 8/1969 | Curtis et al. | 392/396 X |
| 4,266,116 | 5/1981 | Bauer et al. | 239/136 X |
| 4,365,758 | 12/1982 | Schaming | 239/590 |
| 4,480,172 | 10/1984 | Ciciliot et al. | 239/136 X |
| 4,572,943 | 2/1986 | Hogfeldt | 392/396 |
| 4,836,145 | 6/1989 | Ronchi Nee Marchesin | 392/484 X |
| 4,871,115 | 10/1989 | Hessey | 239/136 |
| 5,265,318 | 11/1993 | Shero | 392/396 X |

FOREIGN PATENT DOCUMENTS

| | | | |
|---|---|---|---|
| 807011 | 1/1959 | United Kingdom | 239/397.5 |

*Primary Examiner*—Steven O. Douglas
*Assistant Examiner*—Kathleen J. Prunner
*Attorney, Agent, or Firm*—Bacon & Thomas

[57] ABSTRACT

A fog generating guide tube mounting arrangement includes a barrel having a longitudinal center through hole and two screw holes respectively provided at front and rear sides thereof in axial alignment with the longitudinal center through hole, a connector fastened to one screw hole at the rear side of the barrel to hold a pump tube, a fog generating guide tube detachably mounted in the longitudinal center through hole, the fog generating guide tube having a rear end fastened to the connector, and a front end terminating in an inner threaded portion threaded into the screw hole at the front side of the barrel, an outer threaded portion, a polygonal collar disposed between the inner threaded portion and the outer threaded portion and stopped outside the front side of the barrel, and a nozzle cap threaded onto the outer threaded portion of the fog generating guide tube outside the barrel.

3 Claims, 10 Drawing Sheets

FOG GENERATING GUIDE TUBE MOUNTING ARRANGEMENT

BACKGROUND OF THE INVENTION

The present invention relates to fog generating apparatus for use in a stage or entertainment center, and more specifically to a fog generating guide tube mounting arrangement for a fog generating apparatus which enables the fog generating guide tube to be conveniently detached for maintenance work.

In a stage or entertainment center, a fog generating apparatus may be used to generate fog, so as to produce a misty effect. A fog generating apparatus for this purpose generally comprises a fog generating guide tube mounted in a barrel, heating means installed in the fog generating guide tube to heat a chemical solution into fog. FIGS. 1 and 2 show the mounting arrangement of a fog generating guide tube 10 and a barrel 11 according to the prior art. The barrel 11 has a longitudinal center through hole 12, which receives the fog generating guide tube 10. The fog generating guide tube 10 has a longitudinal center through hole 14, which receives a heating element 15. After the insertion of the fog generating guide tube 10 into the barrel 11, a chemical solution input tube 16 and a fog output tube 17 are respectively connected to two opposite ends of the fog generating guide tube 10, and then the peripheries of the front end and rear end of the fog generating guide tube 10 are welded to the barrel 11, as shown at 18 and 19, respectively. When a chemical solution is delivered through the chemical solution input tube 16 into the fog generating guide tube 10, it is heated by the heating element 15 into fog which is permitted to pass through a fog passage 13 within the barrel 11 around the fog generating guide tube 10 and then to pass out of the fog generating guide tube 10 through the fog output tube 17. This arrangement has a drawback. Because the fog generating guide tube 10 is welded to the barrel 11. it cannot be detached from the barrel 11 for maintenance work. If the fog passage 13 is blocked, the whole assembly becomes useless. FIGS. 3 4 and 5 show another arrangement according to the prior art. According to this arrangement, a fog generating guide tube 21 is mounted in a barrel 20, a heating element 23 is mounted in a slot 22 inside the barrel 20 below the fog generating guide tube 21, a first connector 25 is fastened to one end of the fog generating guide tube 21 outside the barrel 20 for guiding a chemical solution from a pump to the fog generating guide tube 21, and a second connector 24 is fastened to an opposite end of the fog generating guide tube 21 and threaded with a nozzle cap 26 for output of fog. Further, a mounting plate 27 is mounted on the second connector 24 and fastened to the shell 28 of the fog generating apparatus to secure the whole assembly in place. When the fog passage in the barrel 20 is blocked, the outer cover of the fog generating apparatus must be removed from the shell 28, then the mounting plate 27 must be disconnected from the shell 28 and then removed from the second connector 24, and then the first connector 25 and the second connector 24 must be disconnected from the barrel 20 before permitting the fog generating guide tube 21 to be removed from the barrel 20 for cleaning. This arrangement makes the maintenance work difficult.

SUMMARY OF THE INVENTION

The present invention has been accomplished to provide a fog generating guide tube mounting arrangement which eliminates the aforesaid problems. According to one aspect of the present invention the fog generating guide tube mounting arrangement comprises a barrel having a longitudinal center through hole and two screw holes respectively provided at front and rear sides thereof in axial alignment with the longitudinal center through hole, a connector fastened to one screw hole at the rear side of the barrel to hold a pump tube, a fog generating guide tube detachably mounted in the longitudinal center through hole, the fog generating guide tube having a rear end fastened to the connector, and a front end terminating in an inner threaded portion, which is threaded into the screw hole at the front side of the barrel, an outer threaded portion, and a polygonal collar disposed between the inner threaded portion and the outer threaded portion and stopped outside the front side of the barrel, and a nozzle cap threaded onto the outer threaded portion of the fog generating guide tube outside the barrel. According to another aspect of the present invention, the barrel is coated with a layer of heat insulative material and mounted within a shield fastened to the shell of the fog generating apparatus, the shield comprising a bottom frame, which carries the barrel, a top cover frame fastened to the bottom frame and covered over the barrel, and a front cover plate fastened to the bottom frame and the top cover frame at one side, the front cover plate having a center through hole through which the polygonal collar of the fog generating guide tube passes to the outside.

DETAILED DESCRIPTION OF THE PREFERRED EMBODIMENT

Figure 1:
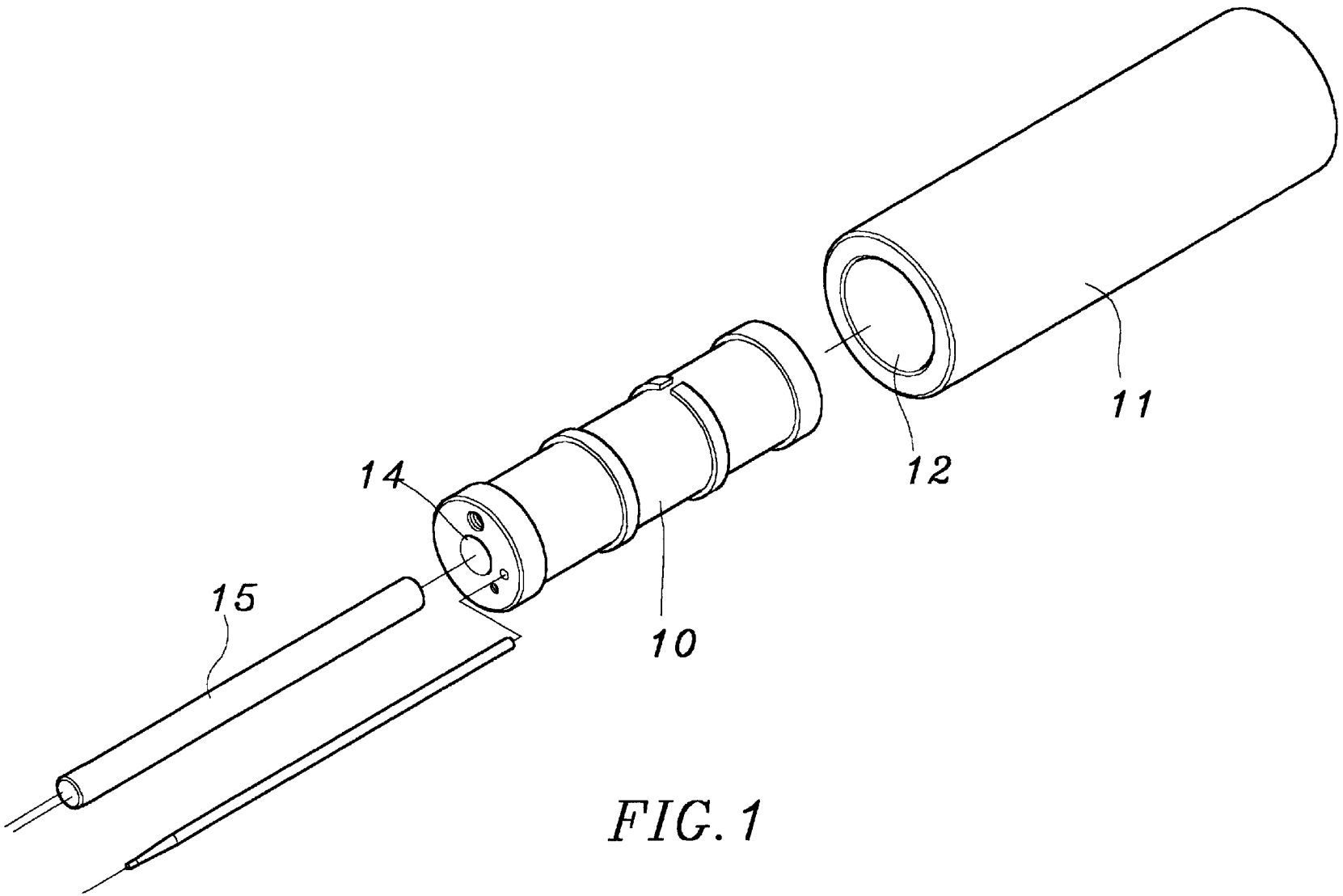
FIG. 1 is an exploded view of a fog generating guide tube mounting arrangement according to the prior art.
Figure 2:
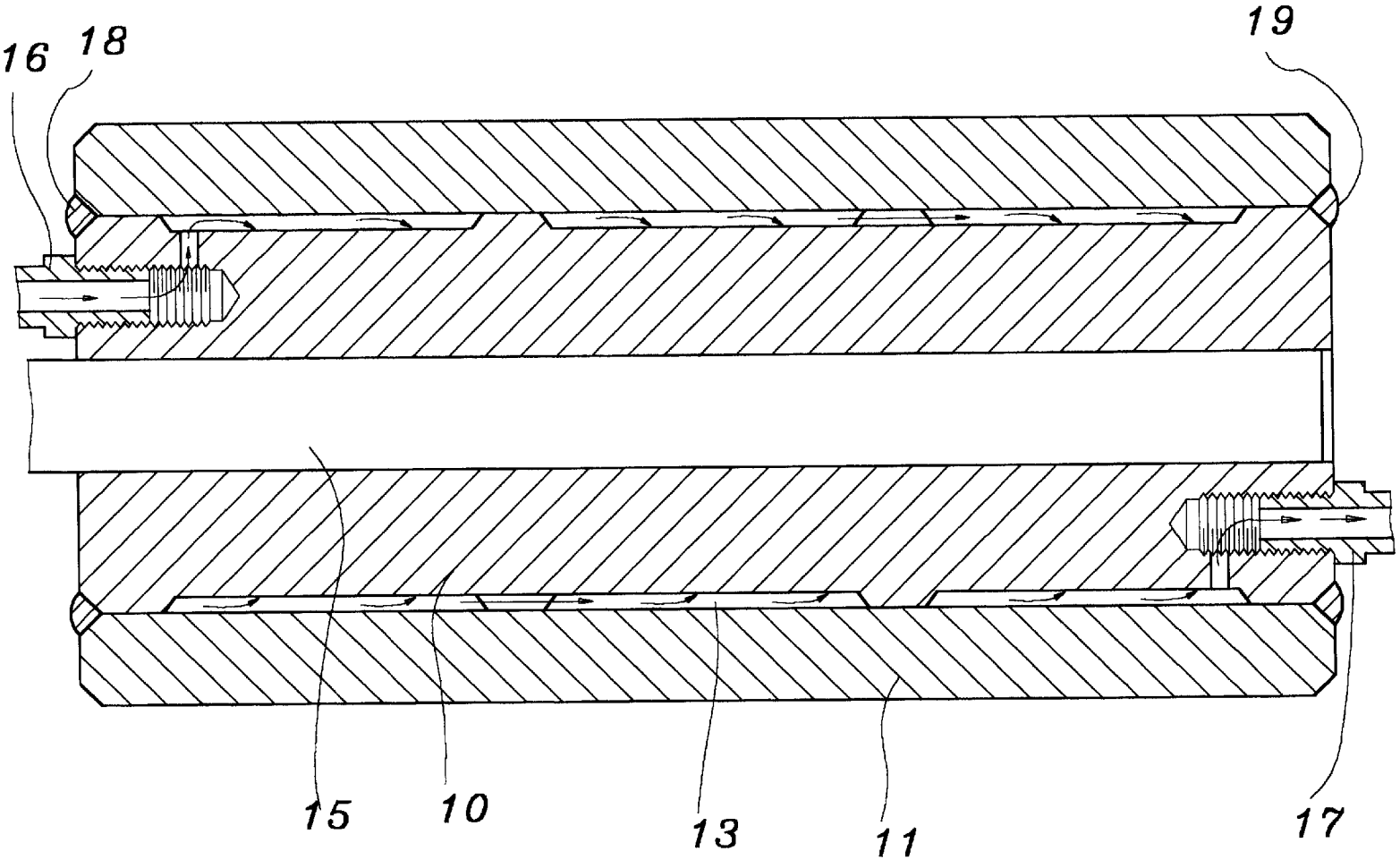
FIG. 2 is sectional assembly view of FIG. 1.
Figure 3:
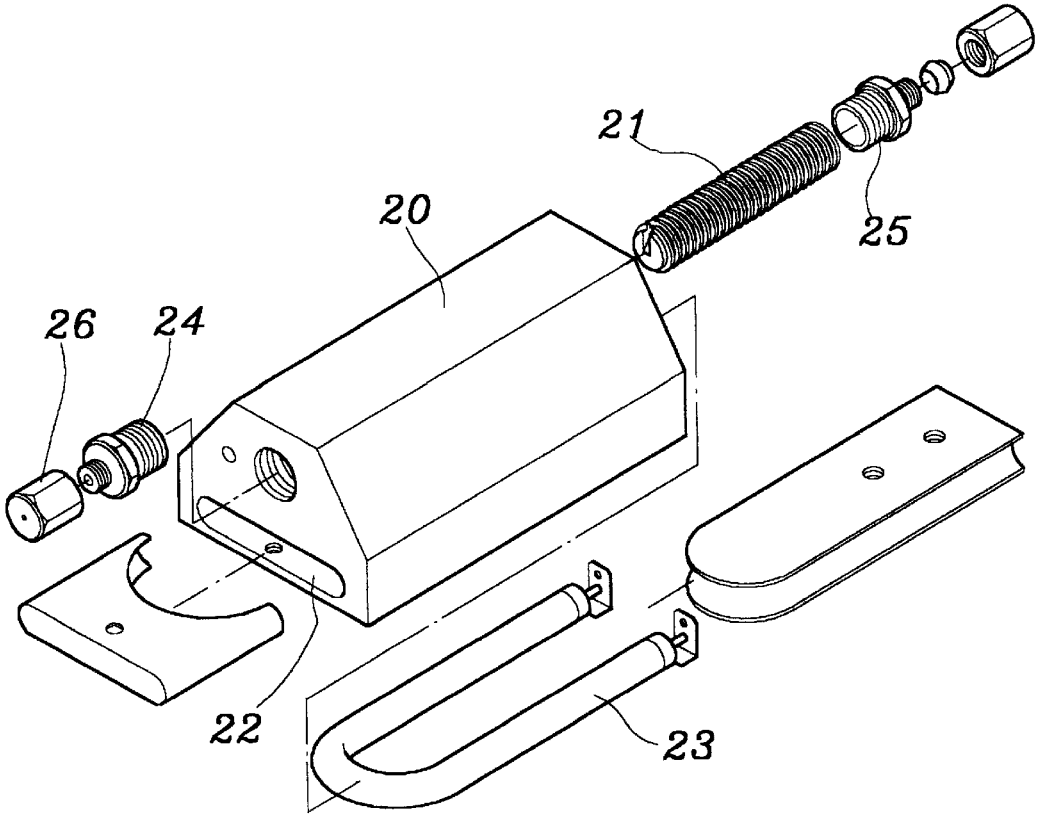
FIG. 3 is an exploded view of another structure of fog generating guide tube mounting arrangement according to the prior art.
Figure 4:
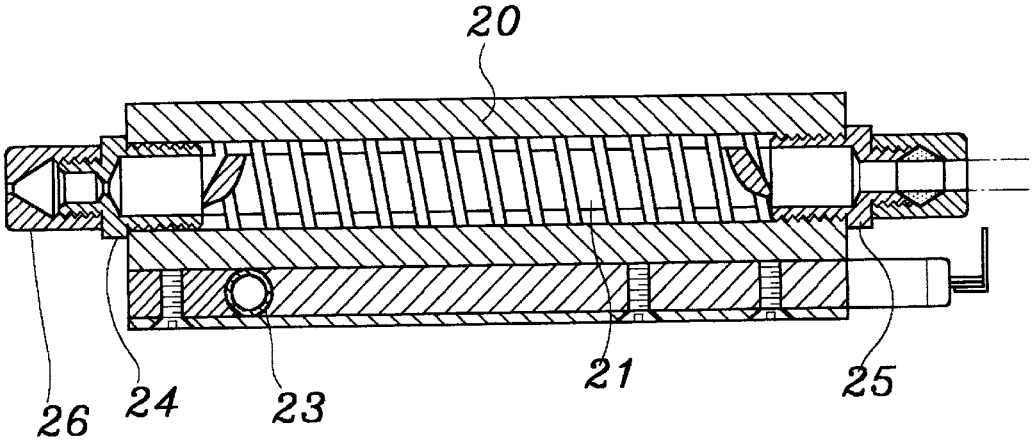
FIG. 4 is a sectional assembly view of FIG. 3.
Figure 5:
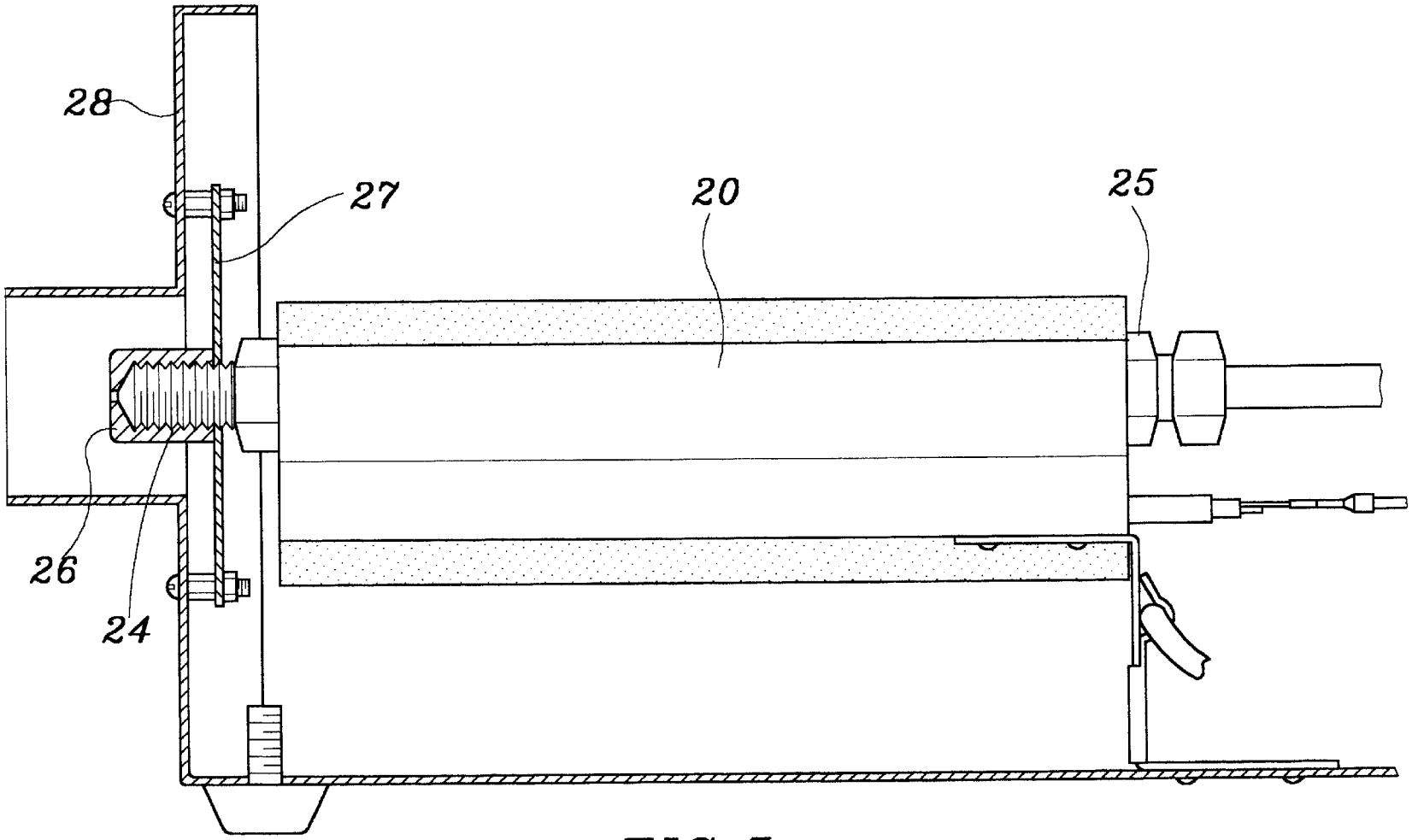
FIG. 5 shows the assembly of FIG. 3 installed in the shell of the fog generating apparatus.
Figure 6:
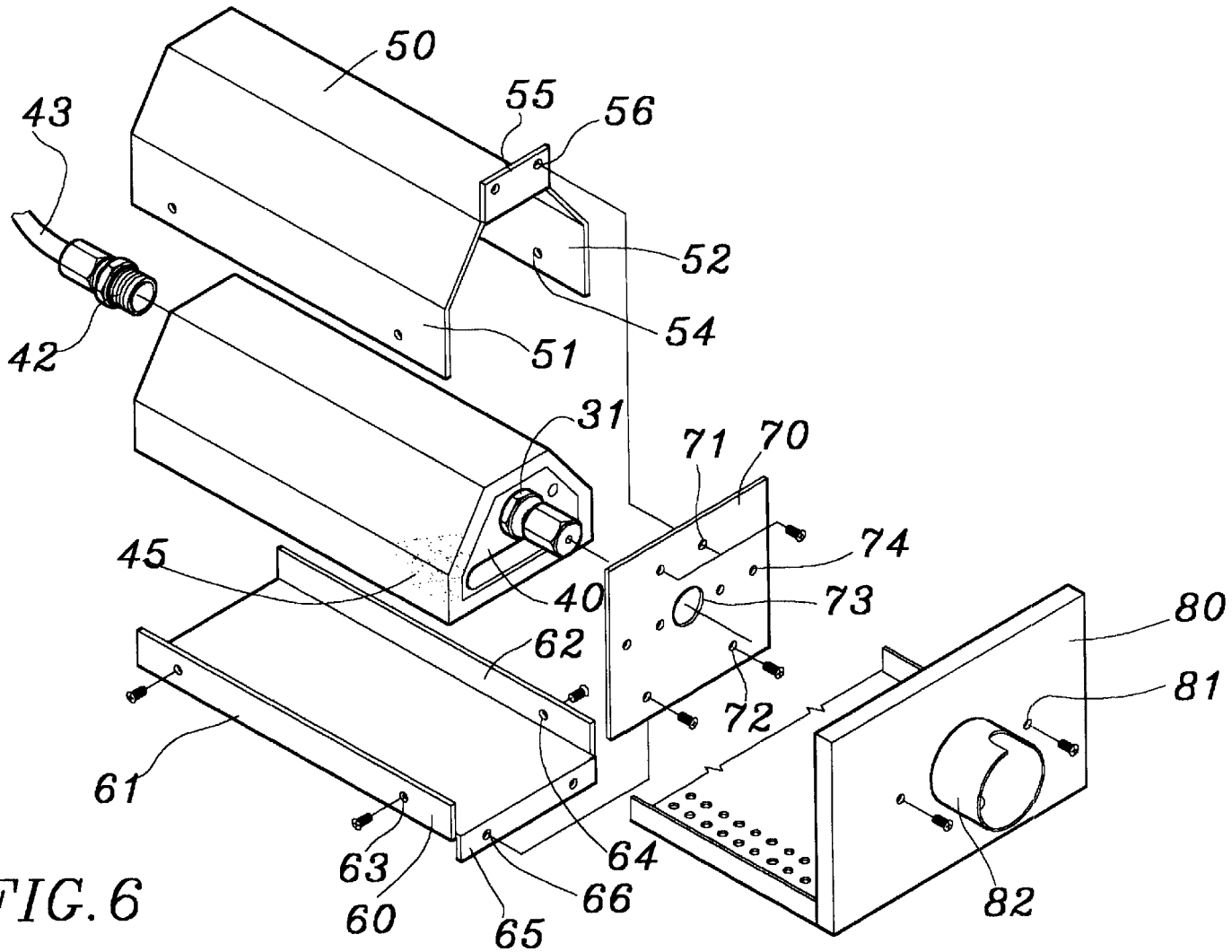
FIG. 6 is an exploded view of the present invention.
Figure 7:
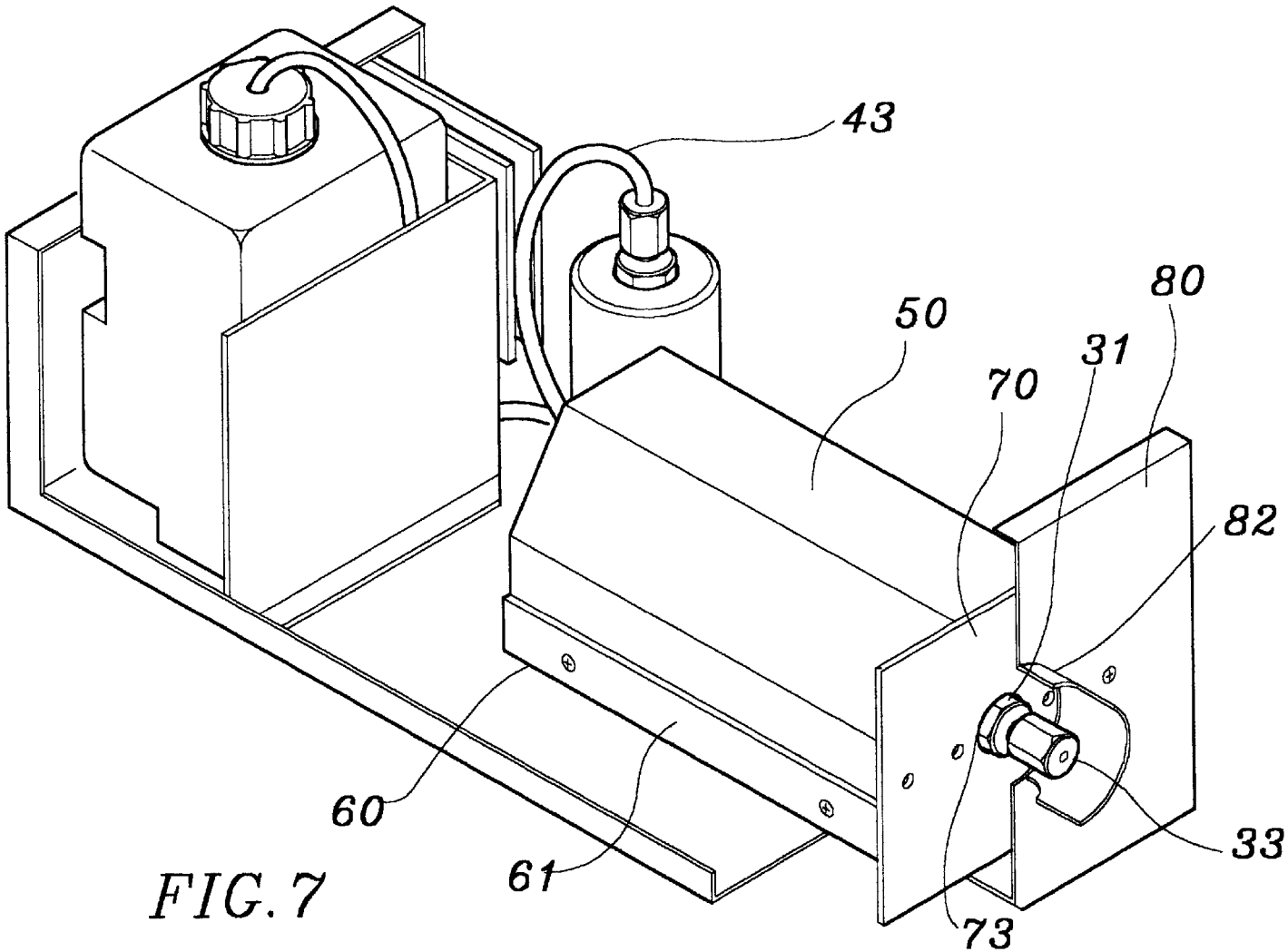
FIG. 7 is an assembled view of the present invention.

Referring to FIGS. 6 through 9 a fog generating guide tube 30 or 300 is inserted into a longitudinal through hole 41 on a barrel 40. A connector 42 is fastened to one end of the longitudinal through hole 41 to hold a pump tube 43. The opposite end of the longitudinal through hole 41 is integral with a screw hole 44 for the positioning of the guide tube 30.

The barrel 40 is coated with a layer of heat-insulative material 45, and mounted in a shield which is comprised of a bottom frame 60 a top cover frame 50, and a front cover plate 70. The shield 50,60,70 is fastened to a shell 80. The top cover frame 50 is covered over the barrel 40 at the top, having two opposite side walls 51,52, a plurality of side mounting holes 53,54 symmetrically provided at the side walls 51,52. an upward front flange 55 raised from the opened front side thereof and a plurality of front mounting holes 56 provided at the upward front flange 55. The bottom frame 60 carries the barrel 40 having two upward side flanges 61,62 raised from two long sides thereof, a plurality of side mounting holes 63,64 symmetrically provided at the upward side flanges 61,62 and respectively fastened to the side mounting holes 53,54 at the top cover frame 50 by rivets, a downward front flange 65 downwardly extended from the front side thereof, and a plurality ol front mounting holes 66 provided at the downward front flange 65. The front cover plate 70 is connected between an upright wall of the shell 80 and the front flanges 55,65 of the top cover frame 50 and the bottom frame 60, having a plurality of upper mounting holes 71 respectively fastened to the front mounting holes 56 at the upward front flange 55 of the top cover frame 50 by rivets, a plurality of lower mounting holes 72 respectively fastened to the front mounting holes 66 at the downward front flange 65 of the bottom frame 60 by rivets, a center through hole 73, and a plurality of screw holes 74 horizontally spaced from the center through hole 73 at two opposite sides and respectively fastened to respective mounting holes 81 at the shell 80 by screws.

Figure 8:
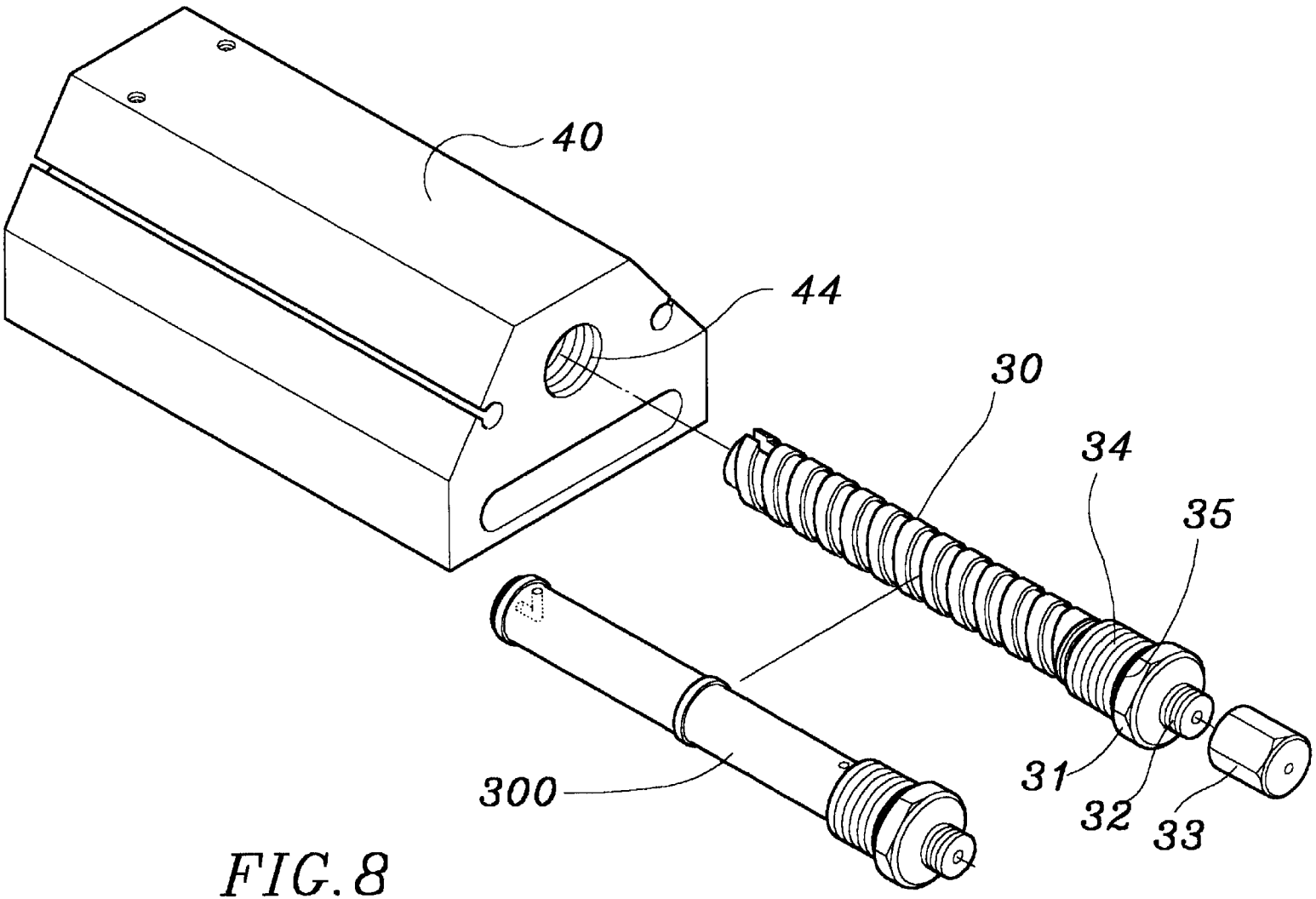
FIG. 8 shows two fog generating guide tubes alternatively used according to the present invention.
Figure 9:
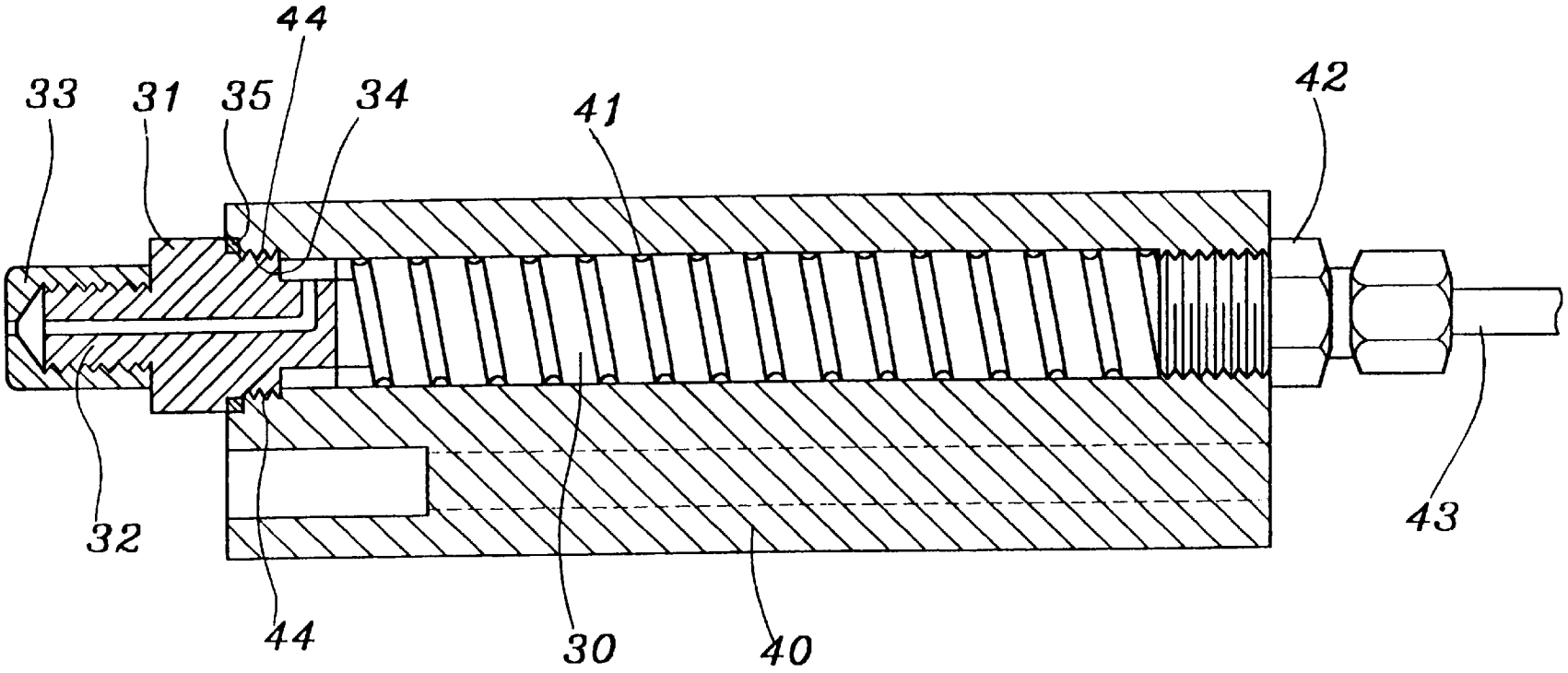
FIG. 9 is a longitudinal view in section showing the fog generating guide tube installed in the barrel according to the present invention.

The guide tube 30 or 300 has a rear end fastened to the connector 42. and a front end terminating in an inner threaded portion 34, an outer threaded portion 32, and a polygonal collar 31 between the inner threaded portion 34 and the outer threaded portion 32. When the rear end of the guide tube 30 or 300 is inserted into the longitudinal through hole 41 on the barrel 40 and connected to or disposed in engagement with the connector 42 the inner threaded portion 34 is threaded into the screw hole 44 at one end of the longitudinal through hole 41, permitting the polygonal collar 31 to be stopped outside the barrel 40, and then a nozzle cap 33 is threaded onto the outer threaded portion 32. Further, a gasket ring 35 is mounted around the inner threaded portion 34 and stopped between the polygonal collar 31 and the barrel 40 to seal the gap. When assembled, the polygonal collar 31 projects Out of the center through hole 73 of the front cover plate 70 and suspended in an access hole 82 at the shell 80. Through the access hole 82, a tool can be attached to the polygonal collar 31 and turned by hand to disengage the guide tube 30 from the barrel 40 for cleaning. In FIG. 8, the guide tube which is referenced by 30 has a spiral guide groove around the periphery, the guide tube which is referenced by 300 has a plain outside surface.

Figure 10:
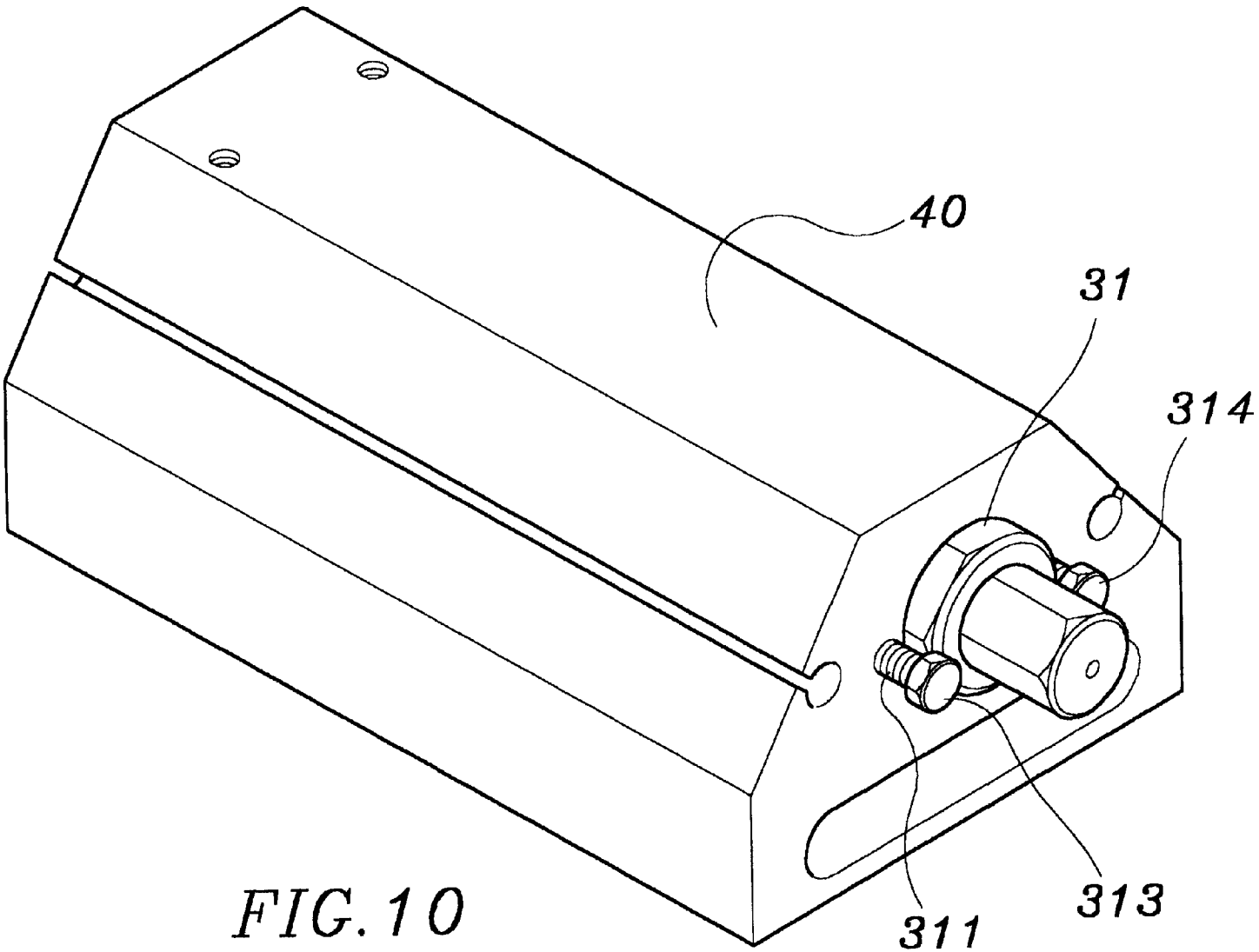
FIG. 10 is a perspective view of an alternate form of the present invention.
Figure 11:
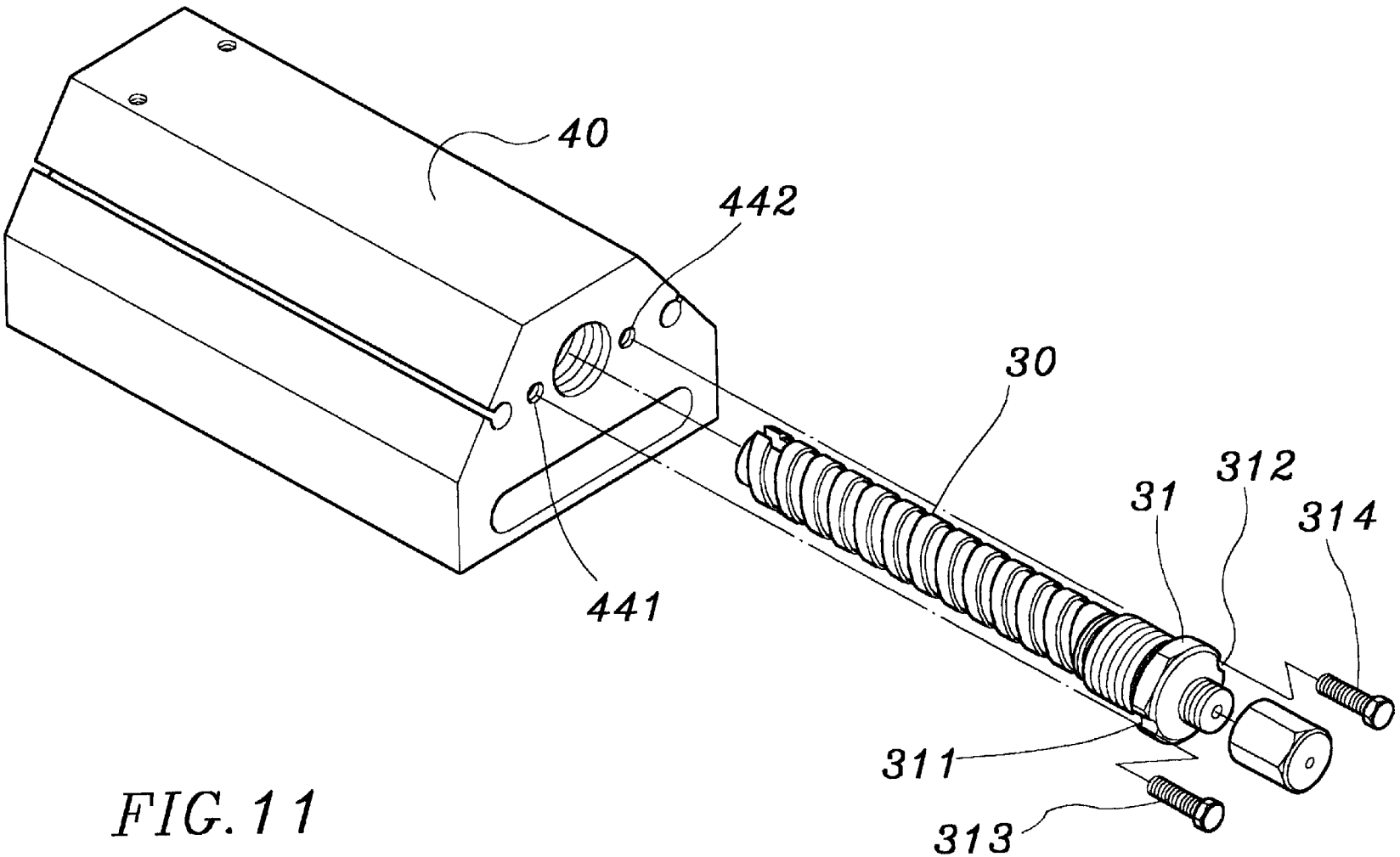
FIG. 11 is an exploded view of FIG. 10.

FIGS. 10 and 11 show an alternate form of the present invention. According to this alternate form, the aforesaid inner threaded portion 34 is eliminated from the guide tube 30, the polygonal collar 31 of the guide tube 30 has two axially extended grooves 311,312 at two opposite sides, and two screw bolts 313,314 are respectively axially inserted through the axially extended grooves 311,312 and threaded into respective screw holes 441,442 at the front side of the barrel 40 to secure the guide tube 30 in the barrel 40.

It is to be understood that the drawings are designed for purposes of illustration only, and are not intended as a definition of the limits and scope of the invention disclosed.

What is claimed is:

1. A fog generating guide tube mounting arrangement comprising a barrel, said barrel having a longitudinal center through hole, a first screw hole at one end of said longitudinal center through hole, and a second screw hole at an opposite end of said longitudinal center through hole, a connector fastened to said first screw hole to hold a pump tube, a fog generating guide tube mounted in said longitudinal through hole, said fog generating guide tube comprising a rear end in engagement with said connector and a front end terminating in an inner threaded portion which is threaded into said second screw hole of said barrel, an outer threaded portion, and a polygonal collar disposed between said inner threaded portion and said outer threaded portion and positioned outside said barrel, a nozzle cap threaded onto the outer threaded portion of said fog generating guide tube outside said barrel, and wherein said barrel is coated with a layer of heat insulative material and mounted within a shield fastened to a shell of a fog generating apparatus, said shield including a bottom frame which carries said barrel, a top cover frame fastened to said bottom frame and covered over said barrel, and a front cover plate fastened to said bottom frame and said top cover frame at one side thereof, and said front cover plate having a center through hole through which said polygonal collar of said fog generating guide tube passes to the outside.

2. The fog generating guide tube mounting arrangement of claim 1, wherein said bottom frame comprises two upward side flanges raised from two opposite long sides thereof and a downward front flange downwardly extended from a front side thereof, said top cover frame comprises two side walls respectively fastened to the upward side flanges of said bottom frame by fastening means and an upward front flange raised from a front side thereof, said front cover plate is fastened to the upward front flange of said top cover frame and the downward front flange of said bottom frame by fastening means.

3. A fog generating guide tube mounting arrangement comprising a barrel, said barrel having a longitudinal center through hole extended to front and rear sides thereof and two screw holes provided at the front side of said barrel and equally spaced from said longitudinal center through hole at two opposite sides, a connector fastened to one end of said longitudinal center through hole at the rear side of said barrel to hold a pump tube, a fog generating guide tube mounted in said longitudinal center through hole, said fog generating guide tube comprising a rear end in engagement with said connector, and a front end terminating in a polygonal collar which is positioned outside the front side of said barrel to seal one end of said longitudinal center through hole and an outer threaded portion, said polygonal collar having two axially extended peripheral grooves, a nozzle cap threaded onto the outer threaded portion of said fog generating guide tube, and two screw bolts axially inserted through said peripheral grooves at said polygonal collar and respectively threaded into the screw holes at the front side of said barrel to fix said fog generating guide tube in position.

* * * * *